United States Patent [19]

Woods

[11] Patent Number: 4,759,558

[45] Date of Patent: Jul. 26, 1988

[54] SKATEBOARD

[76] Inventor: David B. Woods, 3010 Main St., Apt. A, Morro Bay, Calif. 93442

[21] Appl. No.: 46,432

[22] Filed: Apr. 14, 1987

[51] Int. Cl.[4] ..... A63C 17/02

[52] U.S. Cl. ..... 280/11.28; 280/87.04 A

[58] Field of Search ..... 280/11.19, 11.22, 11.23, 280/11.27, 11.28, 87.04 A; D21/227

[56] References Cited

U.S. PATENT DOCUMENTS

| | | | |
|---|---|---|---|
| D. 200,864 | 4/1965 | de Roco | D21/227 |
| D. 214,177 | 5/1969 | Greer | 280/87.04 A |
| D. 214,252 | 5/1969 | Anderson | D21/227 |
| 323,405 | 8/1885 | Elliot | 280/11.31 |
| 1,467,453 | 9/1923 | Remacle | 280/87.04 A |
| 2,245,769 | 6/1941 | Flamm | 280/11.19 |
| 3,790,187 | 2/1974 | Radu et al. | 280/11.2 |
| 4,043,566 | 8/1977 | Johnson | 280/87.04 A |
| 4,194,752 | 3/1980 | Tilch et al. | 280/87.04 A |

FOREIGN PATENT DOCUMENTS 245789 4/1912 Fed. Rep. of Germany .

*Primary Examiner*—John J. Love
*Assistant Examiner*—Richard Camby
*Attorney, Agent, or Firm*—Daniel C. McKown

[57] ABSTRACT

When the front truck of a skateboard is offset laterally to the right from the rear truck, the rider can transfer his weight from the rear truck to the front truck when making a right turn and from the front truck to the rear truck when making a left turn. The truck whose weight is augmented turns through a larger angle than otherwise possible. At some point as the rider leans farther and farther into a right turn, the left rear wheel leaves the ground; the right front wheel leaves the ground when the rider leans strongly into a left turn. When either of these wheels leave the ground, the skateboard steers in a tricycle mode and is capable of extremely sharp turns. The board includes a front portion which is offset from the rear portion, and this offset encourages the rider to assume a more normal stance on the board.

7 Claims, 2 Drawing Sheets

SKATEBOARD

BACKGROUND OF THE INVENTION

1. Field of the Invention

The present invention is in the field of sporting goods, and more particularly relates to a skateboard that is unusually maneuverable.

2. The Prior Art

An Information Disclosure Statement has been lodged in the file of this application. All of the references discussed in it are believed to be distinguishable from the present invention.

The earliest skateboards were made by attaching the front part of a roller skate to the front portion of a board and attaching the rear part of a roller skate some distance away at the rear portion of the board. These relatively primative skateboards were difficult to turn and stopped abruptly when any of the wheels encountered a small rock.

The next step in the evolution of the skateboard came with the introduction of independent trucks. The trucks include two wheels and an axle along with a base including resilient members, by which the axle is attached to the board. This board used relatively narrow trucks and was successful in emulating the feeling of a surfboard. However, because of the narrowness of the skateboard, the rider's toes and heels extended laterally beyond the edge of the skateboard, and this resulted in injuries to the rider. A wider board was needed.

In response to this need for a wider board, boards as wide as 10 or 12 inches then became popular. These wider boards permitted the rider to assume a more normal stance with one foot extended slightly in front of the other foot in the lateral direction on the skateboard. However, the wider trucks used with the wider boards prevented these boards from turning sharply. In order to make sharper turns with these boards, riders learned to apply weight to the portion of the board extending rearward of the rear truck, thereby causing the front wheels to leave the ground, while the rider pivoted on the rear wheels. These boards lacked the feeling of a surfboard, but were an improvement over earlier skateboards.

SUMMARY OF THE INVENTION

A major objective of the present invention is to provide a skateboard that has the feel of a surfboard.

Another objective of the present invention is to provide a skateboard that permits the rider to have greater stability.

Another objective of the present invention is to provide a skateboard capable of making relatively sharp turns.

These objectives were achieved in accordance with the present invention by offsetting the front truck laterally with respect to the rear truck and by using trucks in which the separation between the wheels is approximately 6 inches for a skateboard that is 31 inches long.

Offsetting the front truck laterally with respect to the rear truck encourages the rider to use a more stable stance, which is more like the stance used on a surfboard.

Although some improvement in turning had been expected from the use of the narrower trucks, the degree of improvement far exceeded expectations. It was found that during sharp turns, one of the four wheels would leave the ground and the board then steered like a tricycle in making the sharp turns.

This effect has not been observed on boards lacking the offset trucks of the present invention, and thus the phenomenon appears to be inherent in the present invention.

These and other advantages of the present invention will be discussed below in connection with the detailed description of a preferred embodiment in relation to the drawings. However, the drawings are for the purpose of illustration and explanation, and are not intended to limit the scope of the present invention.

DETAILED DESCRIPTION OF THE PREFERRED EMBODIMENT

Figure 1:
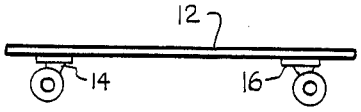
FIG. 1 (PRIOR ART)
FIG. 1 is a side elevational view of a skateboard of the prior art.
Figure 2:
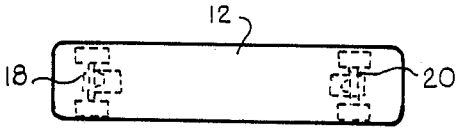
FIG. 2 (PRIOR ART)
FIG. 2 is a top plan view of the prior art skateboard of FIG. 1.
Figure 3:
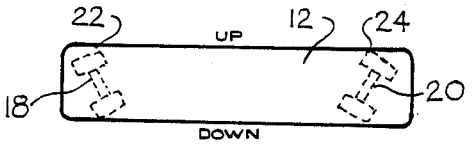
FIG. 3 (PRIOR ART)
FIG. 3 is a top plan view of the prior art skateboard of FIG. 1 showing the direction of the wheels when weight is applied to one side of the skateboard.

FIGS. 1, 2 and 3 relate to a common type of skateboard known in the prior art. That type of skateboard includes a board 12 to the underside of which are mounted the trucks 14, 16. As is well known in the art, these trucks include the two wheels, and their axles. The wheel and axle assembly is mounted to a base that is bolted to the board 12. The base includes resilient elements that absorb road shocks and also provide a restoring force that opposes directional changes of the axles.

As shown in FIG. 2, when the skateboard is in the unloaded condition, the axles 18, 20 are directed laterally of the skateboard. When the skateboard is loaded and the rider distributes his weight more to one side of the board than to the other, the weighted side is pushed down as indicated in FIG. 3 and the opposite side comes up. This pivoting of the skateboard about a longitudinal axis causes the axles 18, 20 to rotate to the positions shown in FIG. 3. This is the configuration of the skateboard when the rider is executing a turn. If the turn is too sharp, the outside wheels 22, 24 lift off the ground, and typically the skateboard skids toward the outside of the turn on the remaining two wheels. When a skateboard is skidding, it is out of control.

It is important to note that in the prior art skateboard of FIGS. 1–3, the trucks were mounted on the same longitudinal line, so that the rear wheels would follow in the tracks of the front wheels when the board is being ridden in a straight line.

Figure 5:
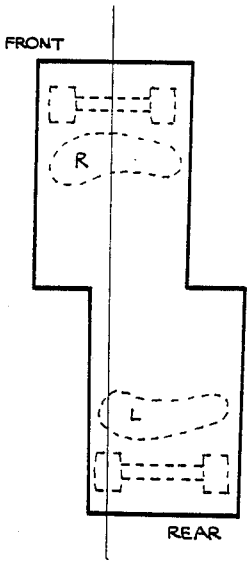
FIG. 5 is a diagram illustrating the present invention in a top plan view.
Figure 4:
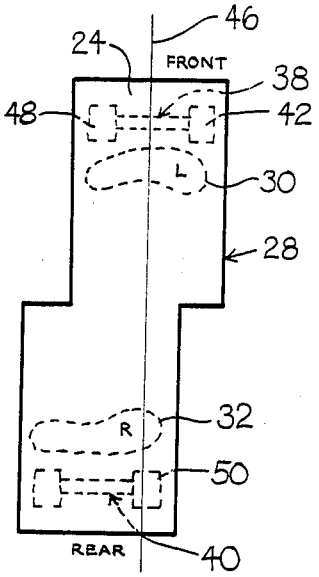
FIG. 4 is a diagram illustrating the present invention in a top plan view.

In contrast, in the present invention, as shown in FIGS. 4 and 5, the front truck is laterally offset with respect to the rear truck.

Just as some people are right-handed and others are left-handed, it has been found that some people prefer to stand on a skateboard with their left foot leading in the direction of motion, while others prefer to face the opposite direction so that their right foot leads in the direction of motion. To accommodate these two ways of riding the skateboard, it is necessary to provide the left-foot-forward embodiment of FIG. 4 and its mirror image, the right-foot-forward embodiment of FIG. 5.

As seen in FIG. 4, the skateboard includes a board 28 that has a front portion 34 and a rear portion 36. In the best mode of practicing the invention, the front portion 34 of the board is offset from the rear portion 36 of the board. This encourages the rider to place his feet on the board in such a way that the left foot shown by the phantom lines 30 is slightly extended from the right foot shown by the phantom lines 32. The front truck 38 is mounted to the underside of the front portion 34 of the board 28.

An imaginary plane 46, seen edge-on in FIG. 4, passes midway between the wheels of the front truck 38. In the best mode of practicing the invention, the rear truck 40 is mounted on the rear portion 36 of the board 28 in such a position that the plane 46 passes through the center of the right rear wheel 50. If the distances between the centers of the front wheels 42, 48 is 2d, then in the best mode, the offset should be d.

In other embodiments, other amounts of offset can be used.

As best seen in FIG. 5, the front axle 37 retains the right front wheel 42 and the left front wheel 48 in coaxial alignment, so that the axis 29 of the right front wheel 42 coincides with the axis 31 of the left front wheel 48. Similarly, the rear axle 39 retains the right rear wheel 50 and the left rear wheel 44 in coaxial alignment, so that the axis 33 of the right rear wheel 50 coincides with the axis 35 of the left rear wheel 44. The front axle 37 is mounted to the board 28 by the front base 41 and the rear axle 39 is mounted to the board by the rear base 43. The front base 41 permits limited resiliently-opposed pivotal motion of the front axle 37 with respect to the board about the axis 45 which extends downwardly to the front. Similarly, the rear base 43 permits limited resiliently-opposed pivotal motion of the rear axle 39 with respect to the board about the axis 47 which extends downwardly to the rear. This type of mounting of the axles 37, 39 to the board is well-known and accounts for the steering effect shown in FIG. 3.

Offsetting the front truck laterally with respect to the rear truck causes the vertical force applied to the trucks to vary depending on whether the rider is making a right turn or a left turn. This is best seen with reference to the diagram of FIG. 6.

Figure 6:
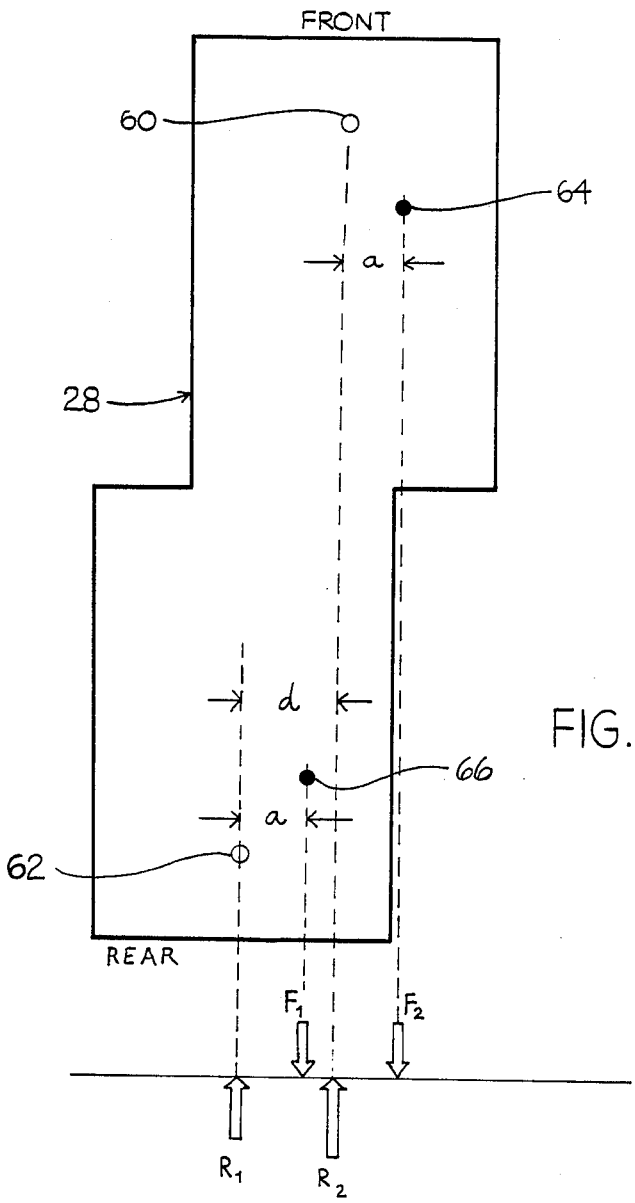
FIG. 6 is a diagram similar to FIG. 4 and illustrating some forces that are applied to the skateboard.

In FIG. 6 the board 28 is assumed to be supported by the front truck at the location 60 and by the rear truck at the location 62. The location 62 is offset laterally from the location 60 by the distance d.

Assume the rider is making a right turn and therefore is leaning to the right and shifting his weight to the balls of his feet rather than supporting himself equally on the balls of his feet and his heels. It is assumed that the balls of his feet are located at the positions 64, 66, each of which is offset from its corresponding truck by the distance a. It is also assumed that the rider is distributing his weight equally between his left foot and his right foot.

The force vectors at the lower portion of FIG. 6 show the equal forces $F_1$ and $F_2$ exerted by the rider's feet on the board. These forces must be countered by the upward reaction of the trucks, as indicated by the vectors $R_1$ and $R_2$. Since $F_1$ and $F_2$ are assumed to be equal and are shifted to the right from $R_1$ and $R_2$, it is necessary for $R_2$ to be greater than $R_1$ if the torques applied to the board are to be balanced. This is borne out by analysis, from which it can be shown that:

for a right turn, $$R_1 = F\left(1 - \frac{2a}{d}\right)$$

$$R_2 = F\left(1 + \frac{2a}{d}\right)$$

and for a left turn, $$R_1 = F\left(1 + \frac{2a}{d}\right)$$

$$R_2 = F\left(1 - \frac{2a}{d}\right)$$

for F equals $F_1$ equals $F_2$.

These equations show that when the rider divides the weight on his left foot equally between his heel and the front part of the foot so that the center of pressure is on a longitudinal line passing through the point 60 and so that the center of pressure of his right foot is located on a longitudinal line through the point 62, a equals 0, and equal amounts of force are applied to the front and rear trucks.

As the rider leans more toward to the right, a starts to increase, and a shift in the forces applied to the trucks becomes evident. The downward force on the front truck increases, and the downward force on the rear truck decreases. When a equals half the offset distance d, all of the force is on the front truck and the rear truck is unloaded.

Likewise, for a left turn, the rider shifts his weight to his heels, and the result is that the rear truck becomes more heavily loaded, while the front truck is more lightly loaded.

The reality of this phenomenon has been verified experimentally. As the rider in making a right turn leans farther and farther to the right, an ever-increasing fraction of the weight is borne by the front truck 38. A point is reached when there is so little weight on the rear truck that the left rear wheel 44 leaves the ground, and the skateboard runs on the wheels 42, 48, and 50. Under these conditions, the skateboard is steering like a tricycle and consequently is capable of very sharp turns. In the extreme situation where all of the weight is borne by the front truck 38, both rear wheels leave the ground and the front axle is at an extreme angle with respect to the direction of motion, producing an extremely sharp turn. Even when the skateboard is operating in the tricycle mode, the rear wheel 50 may be so lightly loaded that it skids laterally, again promoting a very sharp turn.

As the above equations indicate, in a left turn, the rider's weight is transferred to the rear truck 40, and the front truck 38 is only lightly loaded. Further leftward leaning by the rider causes the right front wheel 42 to leave the ground.

Clearly, similar considerations apply to the right-foot-forward skateboard shown in the embodiment of FIG. 5.

The above equations are based on the assumption that the rider divides his weight equally between his left foot and his right foot. However, it is believed that because the left foot is placed ahead of the right foot in FIG. 4, that as the rider leans to the right, he will tend to put more of his weight on his left foot. This further increases the effect analyzed above, by applying even more force to the front truck as the rider makes a right turn and by applying even more force to the rear truck as the rider executes a left turn. This additional effect is a result of the shape of the board 28, which encourages the rider to stand with his left foot slightly forward of his right foot, as shown in FIG. 4.

Thus, there has been described a skateboard that is capable of making very sharp turns without having to be "kicked". The result is a skateboard that more nearly simulates the feeling of a surfboard. In accordance with the invention, offsetting the front truck laterally from the rear truck results in the rider's weight being transferred from the front truck to the rear truck as the rider executes turns. This results in the ability to make very sharp turns.

The foregoing detailed description is illustrative of an embodiment of the invention, and it is to be understood that additional embodiments thereof will be obvious to those skilled in the art. The embodiment described herein together with those additional embodiments are considered to be within the scope of the invention.

What is claimed is:

1. A skateboard comprising in combination:

a board having a front portion and a rear portion;

a front truck including a right wheel and a left wheel, each having an axis;

axle means for retaining said right wheel and said left wheel coaxially and spaced a distance 2d apart between centers with the common axis of the wheels extending laterally when the board is not loaded:

base means mounting said axle means to said board for limited resiliently-opposed pivotal motion about an axis that is directed downwardly and forwardly, whereby when one side of the board is depressed, said axle means pivots to steer said right wheel and said left wheel in a direction corresponding to the depressed side;

a rear truck including a right wheel and a left wheel, each having an axis;

axle means for retaining said right wheel and said left wheel coaxially and spaced a distance 2d apart between centers with the common axis of the wheels extending laterally when the board is not loaded;

base means mounting said axle means to said board for limited resiliently-opposed pivotal motion about an axis that is directed downwardly and rearwardly, whereby when one side of the board is depressed, said axle means pivots to steer said right wheel and said left wheel in a direction opposite the side that is depressed;

said front truck offset laterally from said rear truck.

2. The skateboard of claim 1 wherein said front truck is offset laterally from said rear truck by an amount equal to d.

3. The skateboard of claim 1 wherein said front truck is offset laterally from and to the right of said rear truck.

4. The skateboard of claim 1 wherein said front truck is offset laterally from and to the left of said rear truck.

5. The skateboard of claim 1 wherein the front portion of said board is offset laterally from the rear portion of said board.

6. The skateboard of claim 5 wherein the front portion of said board is offset laterally to the right from the rear portion of said board.

7. The skateboard of claim 5 wherein the front portion of said board is offset laterally to the left from the rear portion of said board.

* * * * *